United States Patent [19]

Rogerson et al.

[11] 4,196,156

[45] Apr. 1, 1980

[54] CARBURETOR WITH LIMITED INTERCONNECTED CHOKE VALVE AND FAST IDLE CAM

[75] Inventors: Jerry B. Rogerson, Northville; Robert S. Harrison, Grosse Ile, both of Mich.

[73] Assignee: Ford Motor Company, Dearborn, Mich.

[21] Appl. No.: 3,183

[22] Filed: Jan. 15, 1979

Related U.S. Application Data

[63] Continuation of Ser. No. 902,307, May 3, 1978, abandoned, which is a continuation of Ser. No. 762,709, Jan. 26, 1977, abandoned.

[51] Int. Cl.[2] ..... F02M 1/10

[52] U.S. Cl. ..... 261/39 B; 261/52

[58] Field of Search ..... 261/39 B, 52

[56] References Cited

U.S. PATENT DOCUMENTS

| | | | |
|---|---|---|---|
| 2,957,465 | 10/1960 | Wagner | 261/39 B |
| 3,263,972 | 8/1966 | Braun et al. | 261/39 B |
| 3,868,935 | 3/1975 | Liebman et al. | 261/39 B |
| 3,906,911 | 9/1975 | Nakada et al. | 261/39 B |

*Primary Examiner*—Tim R. Miles

*Attorney, Agent, or Firm*—Robert E. McCollum; Clifford L. Sadler

[57] ABSTRACT

A carburetor choke valve or plate is interconnected to a fast idle cam mechanism by linkage having a lost motion permitting continued operation of the fast idle cam subsequent to the choke plate attaining a wide open position.

1 Claim, 5 Drawing Figures

CARBURETOR WITH LIMITED INTERCONNECTED CHOKE VALVE AND FAST IDLE CAM

Figure 1:
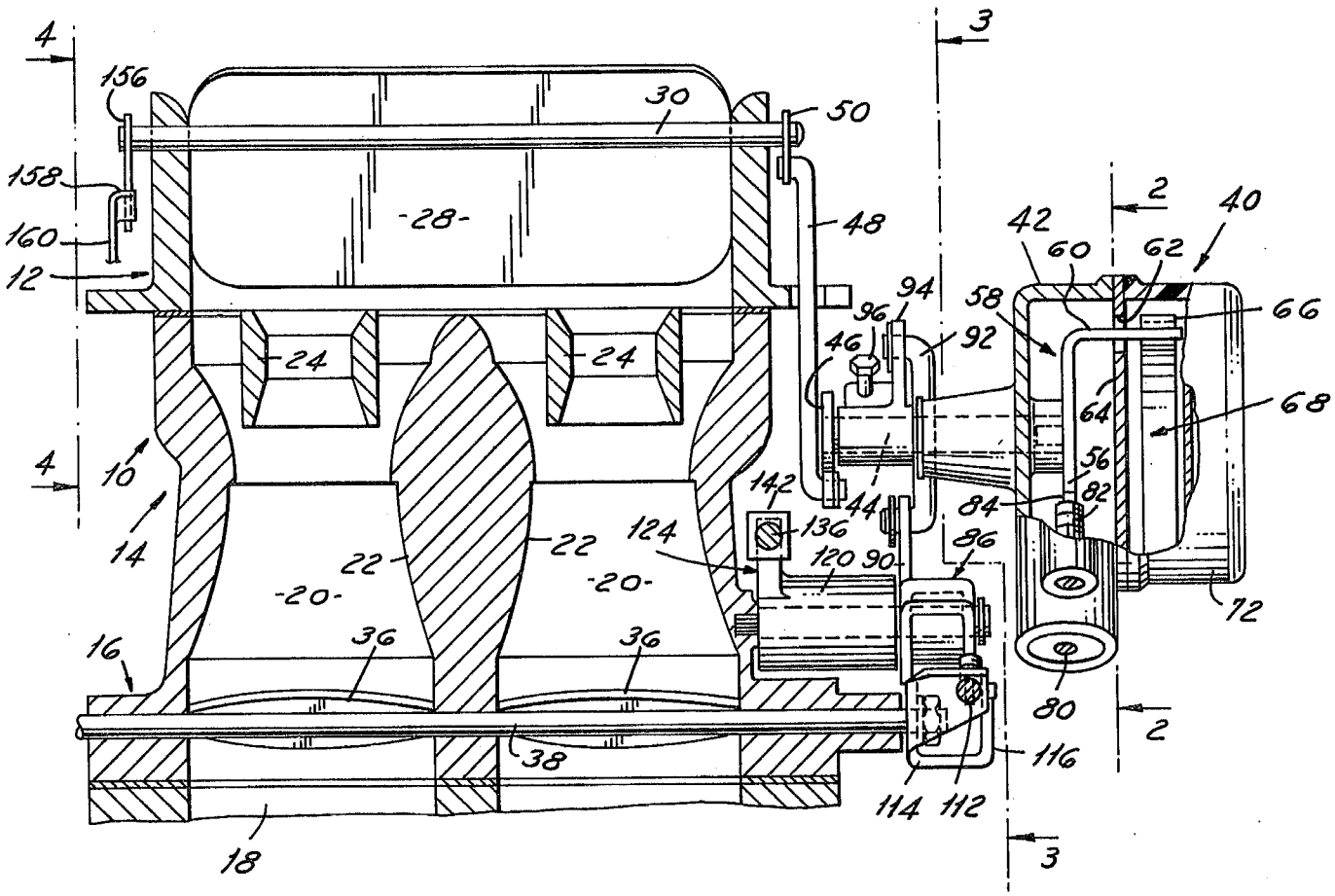

This is a continuation of Ser. No. 902,307, filed May 3, 1978 and now abandoned, which was a continuation of Ser. No. 762,709, filed Jan. 26, 1977 and now abandoned.

This invention relates in general to a cold enrichment system for an automotive type carburetor. More particularly, it relates to an apparatus for at times divorcing the carburetor choke valve from the fast idle mechanism to permit comeoff of the choke valve prior to release of the fast idle cam to reduce emissions while at the same time providing favorable operating conditions.

Most commercial carburetors include a choke construction in which the choke valve and fast idle cam are interconnected in such a way that when the choke valve attains a wide open vertical condition, the fast idle cam by that time has caused the throttle valve to be moved to its normal idle speed essentially closed position. For emission purposes, any delay in opening the choke valve necessarily maintains a richer air/fuel ratio because of the decreased air supply.

This invention interconnects the choke valve to the fast idle cam mechanism by a lost motion means that permits the choke valve to be fully open while the fast idle mechanism is still on the last step of the cam. This will cause a leaner mixture to flow to the engine and yet not cause stalling because the throttle valve is still maintained in a fast idle position permitting a greater volume of flow to the engine.

It is an object of the invention, therefore, to provide a carburetor cold enrichment system that includes a choke valve that is interconnected with the fast idle mechanism by means permitting relative movement between the two to allow the choke valve to be moved to positions without necessarily a corresponding movement of the fast idle mechanism.

It is another object of the invention to provide a carburetor choke construction consisting of a choke valve interconnected by a lost motion pin and slot type connection to a fast idle cam that permits the fast idle cam to maintain an extra degree of rotation of the throttle valve after the choke valve has attained a vertical wide open position, to maintain a higher engine rpm with a leaner overall air/fuel mixture flowing to the engine.

It is a still further object of the invention to provide a carburetor choke construction that includes a choke valve that is unbalance mounted and operatively connected to a thermostatically responsive coiled spring to be rotated between open and closed positions in response to changes in temperature from the engine normal operating level, the choke valve being interconnected with the conventional fast idle cam by a lost motion connection so that relative rotation may occur between the two whereby rotation of the choke valve to its nearly vertical, wide open position permits an additional degree of rotation of the fast idle cam before the fast idle cam reaches the position in which the fast idle throttle stop screw will locate the throttle valve at its normal idle speed position.

Figure 2:
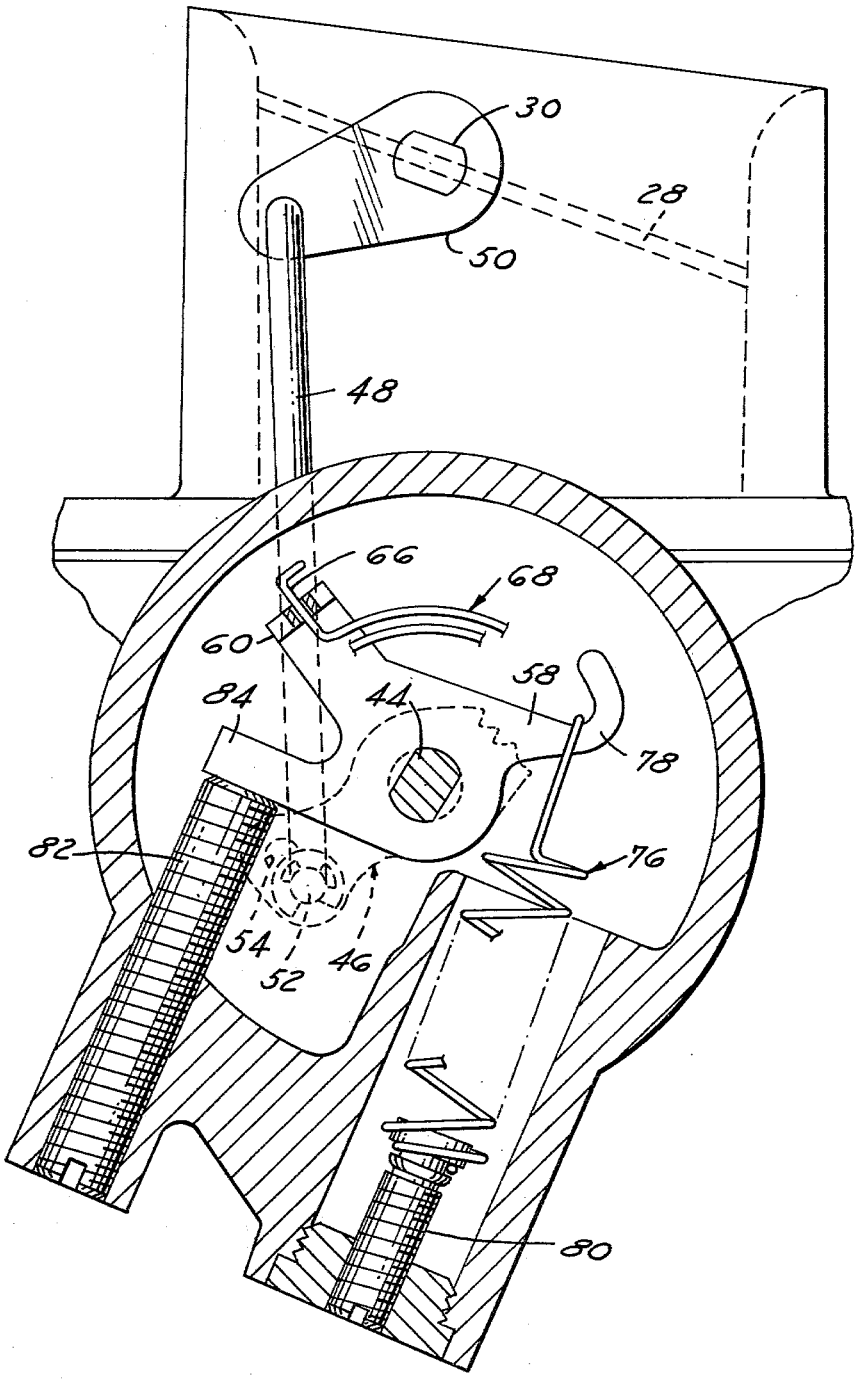
Figure 3:
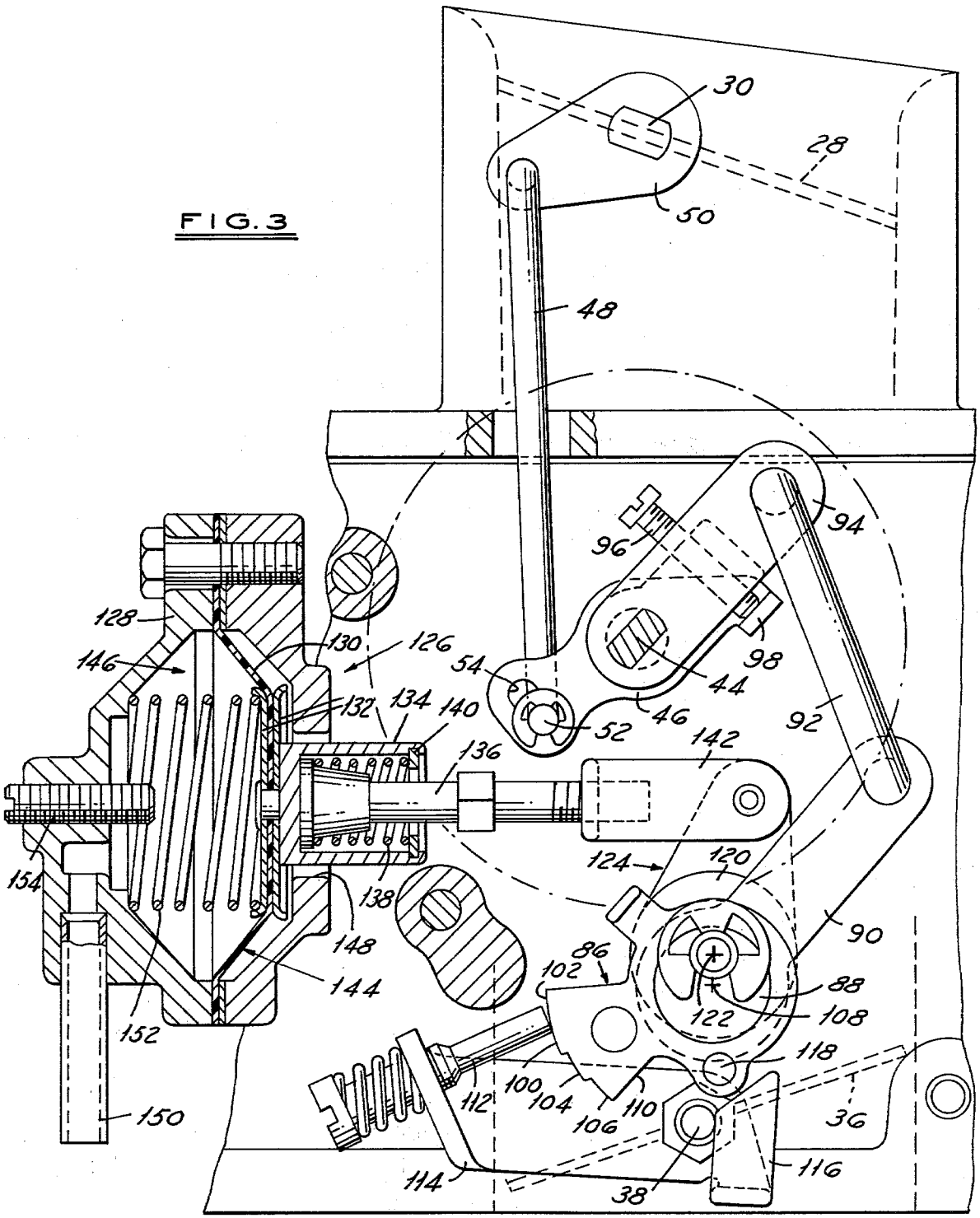
Figure 4:
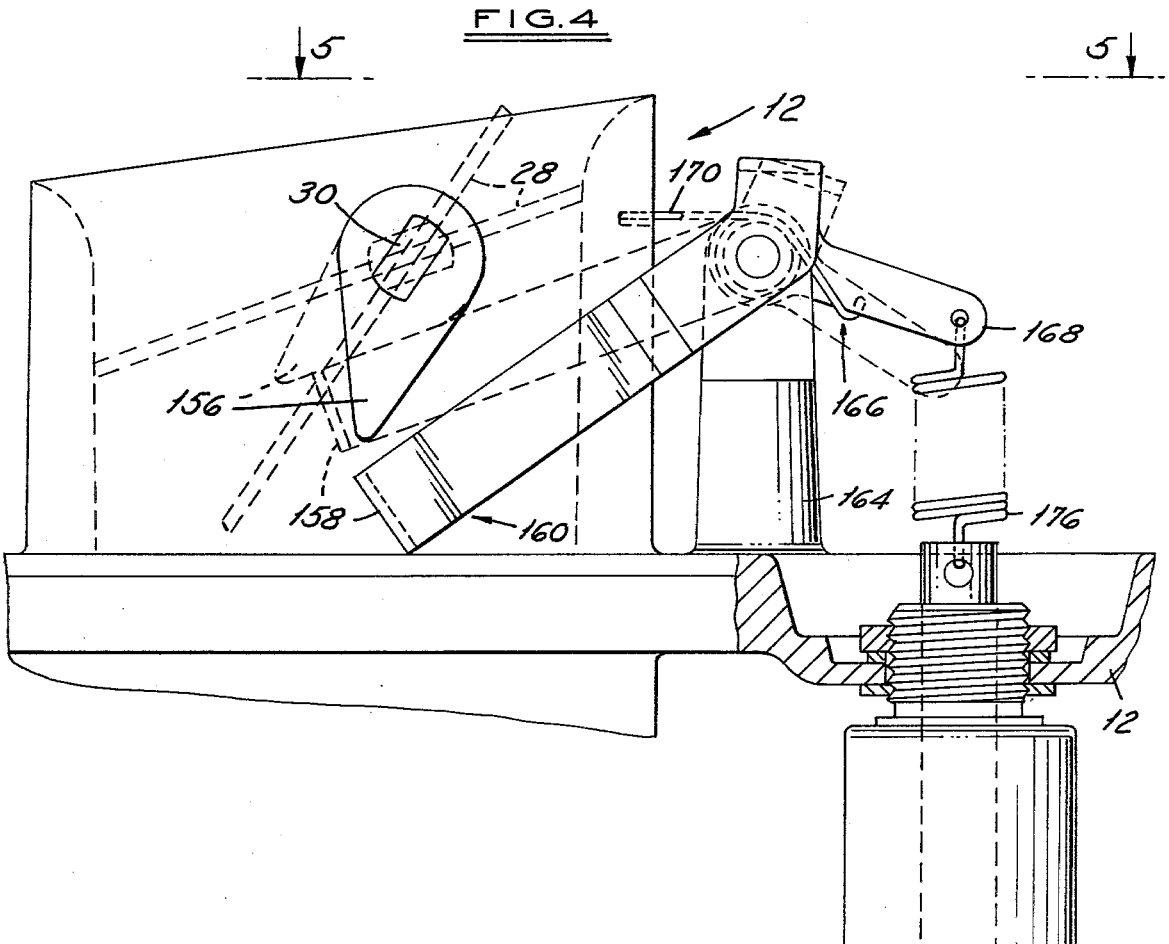
Figure 5:
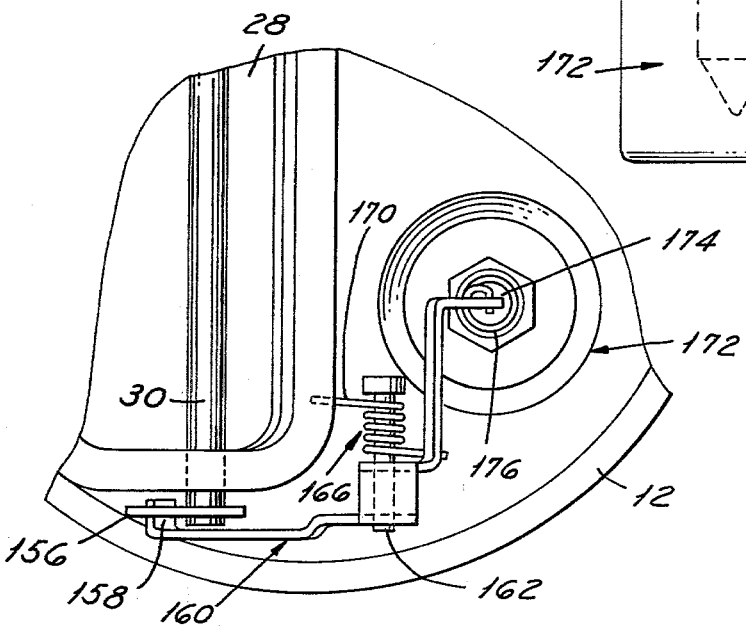

Other objects, features and advantages of the invention will become more apparent upon reference to the succeeding detailed description thereof, and to the drawings illustrating the preferred embodiment thereof, wherein:

FIG. 1 is a cross-sectional view of a portion of a carburetor embodying the invention:

FIGS. 2, 3 and 4 are side elevational views, on an enlarged scale, with parts broken away and in section, of portions of the FIG. 1 showing taken on planes indicated by and viewed in the direction of the arrows 2—2, 3—3 and 4—4, respectively, of FIG. 1; and FIG. 5 is a top plan view of a detail of FIG. 4 viewed in the direction of the arrows 5—5 of FIG. 4.

FIG. 1 is obtained by passing a plane through approximately one-half of a known type of two-barrel, downdraft carburetor 10. It includes an air horn section 12 secured to a main body portion 14, and a throttle body 16. The throttle body is mounted over an intake manifold indicated partially at 18 leading to the engine combustion chambers.

Main body portion 14 contains the usual air/fuel mixture induction passages 20 having fresh air intakes at the air horn ends, and connected to manifold 18 at the opposite ends. The passages are each formed with a main venturi section 22 in which is suitably mounted a boost venturi 24.

Air flow into passages 20 is controlled by a choke valve 28 that is unbalance mounted on a shaft 30. The choke valve thus may fall open by gravity or be urged to an open position by air flow against it. Shaft 30 is rotatably mounted in side portions of the carburetor air horn, as shown. Flow of the usual fuel and air mixture through each passage 20 is controlled by a conventional throttle valve 36 fixed on a shaft 38 rotatably mounted in the throttle body 16. The throttle valves are rotated in the usual manner by depression of the conventional vehicle accelerator pedal. They move from the idle speed or essentially closed positions shown to wide open positions essentially at right angles to that shown.

Choke valve 28 rotates from the closed position shown in FIGS. 1 and 2 to a nearly vertical, wide open, essentially inoperative position. In this latter position, the choke valve provides a minimum obstruction to airflow. The rotative position of choke valve 28 is controlled in part by a thermostatically controlled mechanical operating mechanism 40 located on one side of the carburetor. The latter includes a hollow choke housing portion 42 that is bolted, by means not shown, to cast extensions of the carburetor main body portion 14. The housing is apertured for rotatably supporting one end of a choke valve control shaft 44, the other end fixedly mounting a bellcrank-type lever 46 (see FIG. 3). The latter is pivotally connected by a link 48 to a lever 50 fixed on choke valve shaft 30.

It should be noted that lever 46 and link 48 are interconnected by a lost motion means (FIGS. 2 and 3) consisting of the right angled end 52 of link 48 constituting a pin engagable in an elongated slot 54 formed in lever 46. It will be clear that rotation of shaft 44 in either direction as seen in FIGS. 2 and 3 will rotate choke valve 28 in a corresponding direction. This will open or close the carburetor air intake, as the case may be, once the pin end 52 has moved to one or the other end of slot 54, as the case may be. The purpose of this arrangement will become clearer later.

The end of shaft 44 that projects into housing 42 has fixed on it the body portion 56 of a thermostatic spring lever 58. The lever has one portion 60 that projects outwardly at right angles and through a slot 62 in an insulating gasket 64. It has a bifurcated end that engages the end 66 of a thermostatically responsive, bimetallic, coiled spring element 68. The inner end portion of the coiled spring is fixedly secured on the end of a nipple 70 formed as an integral part of a choke cap 72 of heat insulating material.

The thermostatic spring element 68 will expand as a function of changes in temperature of the air in the chamber 76 defined within cap 72 and housing 42. Accordingly, changes in temperature from the normal engine operating level will circumferentially move end 66 of spring lever 58 to rotate shaft 44 and lever 58 in one or the other directions, as the case may be. The force of bimetallic spring 68 is chosen such that at the normal engine operating temperature, the circumferential movement of the spring will have moved the choke valve 28 to a wide open vertical position. Decreases to levels below the normal temperature will progressively increase the biasing force on the choke valve in a closing direction.

As seen in FIG. 2, opposing the force of spring 68 is a modulating tension spring 76. It is hooked at its upper end to an extension 78 of spring lever 58 and anchored at its opposite end to an adjustable screw 80. The force of modulating spring 76 is chosen such that at temperature levels between 60° F. and 100° F., the spring force will exceed the torque or closing biasing force of thermostatic spring 68. The position at which thermostatic spring 68 and tension spring 76 are in equilibrium will determine the position of spring lever 58.

As shown in FIG. 2, the thermostatic spring normally biases lever 58 against an adjustable stop 82. The latter determines the cold engine minimum pulldown or engine running position of choke valve 28. That is, the coldest position of the end 66 of thermostatic spring 68 will position an extension 84 of spring lever 58 against stop 82, and locate lever 46 as shown. The most the choke valve 28 then can open is to fall by gravity or be moved by airflow against it to move the pin end 52 of link 48 upwardly to the top of slot 54. As the temperature rises to above 65° F., however, the modulating force of tension spring 76 causes the levers 58 and 46 to be moved clockwise to new equilibrium positions, as stated above, which increases the choke pulldown for choke valve 28. Thus, it allows the choke valve to have a greater opening that is more in line with the leaner air/fuel ratio the warmer temperature level is calling for to maintain the engine running.

At some warm engine temperature level around 100° F., for example, the force equilibrium between springs 68 and 76 will be such as to permit spring 76 to retract to its dead height, and thereafter have no effect on the decreasing closing force of thermostatic spring 68. The adjustability of screw 80 will determine the amount of modulating force applied to thermostatic spring 68, and also the temperature range over which the modulation will occur.

During cold engine operation, it is necessary to open throttle valves 36 from their normal, essentially closed idle speed positions to allow enough extra air/fuel mixture into the engine to prevent it from stalling due to the extra friction, greater viscosity of the lubricant, etc. Then as the engine warms, it is desirable to progressively close the throttle valves to the idle speed positions to reduce engine speed. As best seen in FIGS. 1 and 3, a fast idle cam 86 is rotatably mounted on a shaft 88. The cam has a lever 90 projecting from one side that is pivotally connected by a link 92 to a second lever 94. The latter is rotatably mounted on shaft 44 and adjustably mounts a screw 96. The screw has a one-way engagement with a finger or right angle tab 98 that is integral with and projects laterally from choke lever 46. The weight and location of lever 94, link 92, lever 90 and fast idle cam 86 is such that the cam will always fall by gravity in a clockwise direction so that screw 96 will follow the movement of tab 98 of lever 46. This will effect rotation of the fast idle cam clockwise or counterclockwise progressively as the temperature of thermostatic spring 64 increases or decreases, respectively.

The opposite side of fast idle cam 86 is formed with an edge 100 having in this case, three circumferentially contiguous steps, a high cam step 102 and lower cam steps 104 and 106. Each step in counterclockwise circumferential succession is defined by a face that is of less radial extent from the axis of rotation 108 of the cam than the previous one, the lower step 106 being followed by an opening 110. The steps and opening constitute abutments or stops in the path of movement of a screw 112. The latter is adjustably mounted on a lever 114 fixed on throttle shaft 38. The radial depth of opening 110 is chosen such that when the fast idle cam is rotated to permit movement of screw 112 into the opening 110, throttle valves 36 then will be permitted to rotate to their normal engine operating temperature level idle speed positions essentially closing the induction passages. Engagement of the screw 112 with each of the steps 106, 104 and 102 as the cam is rotated counterclockwise upon temperature decreases then will progressively locate the idle speed position of the throttle valves at more open positions.

The fast idle cam is repositioned for a cold start to its fastest idle speed position by depressing the conventional accelerator pedal to open the throttle valves to move the abutment screw 112 away from the face of cam 86. That is, even though the engine temperature may decrease to a level calling for counterclockwise rotation of fast idle cam 86 by the thermostatic spring 68, if screw 112 engages steps 104 or 106, the frictional resistance between the two prevents rotation of the cam.

A kickdown operation of a warm engine is also provided. Depressing the conventional accelerator pedal to the floor rotates the throttle valve shaft 38 a maximum amount. Fixed on the throttle shaft is an actuator 116 which when rotated engages a pin 118 projecting from the fast idle cam 86. The movement of the pin moves the fast idle cam and through links and levers 90, 92, 94, 46, 48 and 59 opens choke valve 28 to relieve the flooded or rich mixture stall condition by leaning the mixture.

The choke valve usually is positioned essentially closed for cold engine starts. This lessens airflow and increases the vacuum fuel metering signal to draw in enough extra fuel to provide sufficient vapor for starting the engine. Once the engine fires, however, the throttle plates must be open enough to permit the engine to draw in enough fuel and air to raise the engine cranking speed of say 100 r.p.m. to a 1,000 r.p.m. fast idle speed that will sustain engine operation. Once the engine running operation is attained, then the overrich starting mixture no longer is required and it becomes desirable to reduce both the choke valve and throttle plate openings to lower settings, but still ones that provide a richer setting than that which provides the normal idle speed when the engine has warmed up.

The position of the thottle valve, therefore, is important. The more it is cracked open from the closed position during engine cranking operations, the greater the volume of air and fuel inducted. Therefore, for engine starts, the throttle valve stop screw 112 is scheduled to be located against the high step 102 of fast idle cam 86 to provide the richest cranking air/fuel mixture. Once the engine has started, however, then the throttle valves are automatically closed down by a small amount that will reduce the airflow and consequently the engine idling speed, without disengaging the throttle valve stop or abutment from the high step of the fast idle cam.

More particularly, the fast idle cam is eccentrically secured on the end of a shaft 120 rotatably mounted in the carburetor body and having an axis of rotation 122. Secured to the opposite end of shaft 120 is a lever 124 that is pivotally connected to a manifold vacuum actuated servo 126.

The servo 126 consists of a hollow two-piece housing 128 between which is edge mounted an annular flexible diaphragm 130. A pair of retainers 132 are riveted to the diaphragm and to the cup shaped housing 134 of a flexible connector assembly. Slidable within housing 134 is an actuating rod 136, the base of which is formed as a seat for a spring 138. The opposite end seats against a retaining ring 140. Rod 136 is screwed to an adaptor 142 that is pivotally connected to lever 124.

Servo diaphragm 130 divides housing 128 into an air chamber 144 and a vacuum chamber 146. Air at ambient pressure communicates with chamber 144 through the opening 148. A tube 150 connects engine manifold vacuum from any suitable source to vacuum chamber 146. A spring 152 normally urges diaphragm 130 and thus the fast idle cam 86 to the positions shown.

In brief, when the engine starts, manifold vacuum is communicated to the vacuum side of diaphragm 130 via tube 150. As diaphragm 130 strokes leftwardly, compressing spring 152, lever 124 is rotated about center 122. Fast idle cam 86, having its center of rotation at point 108 on shaft 88, moves rightwardly as diaphragm 130 strokes leftwardly. Due to throttle return cable and other throttle closing forces, screw 112 is held in contact with and follows the rightward movement of fast idle cam 86. This closes down the throttle valves. Therefore, by using a diaphragm motor to eccentrically reposition the fast idle cam, automatic and gradual speed decay is achieved.

Adjustment of rod 136 qualifies the diaphragm assembly to the eccentric lever 124. Adjustment of screw 112 determines the cranking throttle angle, and also the engine run-up speed that will occur before manifold vacuum is realized by diaphragm 130. By employing delay restrictors, not shown, between manifold vacuum tube 150 and diaphragm 130, the elapsed time for automatic speed decay can be varied to suit any calibration. Adjustment of stop screw 154 sets the stroke of diaphragm 130 and the subsequent speed to which the engine will run down after start-up. If adjusting screw 112 is in contact with any step on cam 86, the initial run-up speed will be higher than the after automatically reduced speed established by the step radius. If adjusting screw 112 is not in contact with fast idle cam 86, the idle speed will be as determined by the conventional throttle anti-dieseling solenoid or idle speed adjusting screw, not shown.

As stated previously, the start of a cold engine requires a richer mixtrue than that of a warmed engine because less fuel is vaporized. Therefore, the choke valve must be shut or nearly shut to restrict air flow and increase the pressure drop across the fuel inlet to draw in more fuel and less air. Once the engine does start, however, then the choke valve should be opened slightly to lean the mixture to prevent engine flooding as a result of an excess of fuel.

The mechanisms shown in FIGS. 4 and 5 and indicated partially on the left hand side of the carburetor in FIG. 1 accomplish this objective.

The choke valve shaft 30 has a lever 156 fixed to it for cooperation with the right angled tab end 158 of an actuating lever 160. Lever 160 is pivoted on a shaft 162 mounted on a pedestal 164. A return spring 166 is hooked against one arm portion 168 of lever 160, the opposite end 170 of the spring being anchored in the choke housing. Spring 166 urges lever 160 downwardly out of engagement with choke shaft lever 156 to permit the choke valve 28 to fall open by gravity or be forced open by the air load or air flow against it, to a position as dictated by the pulldown mechanism described in connection with FIG. 2.

The choke valve 28 is forceably closed during engine starts, i.e., the cranking cycle, by a conventional solenoid 172. The latter is adjustably mounted on the carburetor air horn 12 and has a slidable armature 174. The armature is connected by an extending spring 176 to arm 168 of lever 160. The solenoid is wired by a lead 178 to the engine ignition or starting circuit, not shown, so that it will be energized whenever the ignition switch is turned to the start position and deenergized when the ignition switch is released to the engine running position.

With the ignition switch in the start position, solenoid 172 pulls in extending spring 176 and actuating lever 160. When rotated about pivot 162, the tab end 158 of lever 160 contacts lever 156, as seen in dotted lines, closing choke valve 28. In order to achieve engine speed run-up, spring 176 extends against the air load on choke valve 28. At this point, the driver realizes the engine is running and he releases the ignition switch. With a hold-in force no longer applied at solenoid 172, spring 170 returns lever 160 to its deenergized position so that the choke valve 28 can rotate freely as the engine warms up.

For starts in ambient temperatures above 100° F., the thermostatic spring 68 will have positioned choke valve 28, and likewise lever 156 to the full line position shown so that when solenoid 172 is energized, the end of lever 160 no longer will contact lever 156, and the choke valve will remain open.

In overall operation, except for FIG. 4, the parts are shown in the positions they attain when the engine is conditioned for a start or cranking operation below 100° F. As seen in dotted lines in FIG. 4, when the engine ignition switch is turned to the on or start position, solenoid 172 is energized and pulls down on extending spring 176. This moves the actuating lever 160 up against the edge of lever 156 and positively closes the choke valve. At the same time, as seen in FIG. 2, the thermostatic spring 68 has pushed lever 58 against the minimum stop 82, which predetermines the minimum pulldown opening of the choke valve. As soon as the driver realizes that the engine is running, he releases the ignition switch which then deenergizes solenoid 172 and allows choke valve 28 to drop by gravity and the air load against it. As seen in FIGS. 2 and 3, the choke lever link 48 is free to move within slot 54 of lever 46 so that the degree of opening is determined by the position of lever 46 and lever 58. Accordingly, the choke valve will move to a slightly cracked open position which allows more air to enter the carburetor to lean out the previously rich starting mixture.

Simultaneously, as seen in FIG. 3, rotation of thermostatic spring 68 in the choke valve closing direction locates the lever 46 as shown thereby moving the fast idle cam linkage 94, 92 and 90 to its counterclockwisemost position shown. Upon depression of the conventional accelerator pedal, the throttle valve shaft 30 rotates to release fast idle screw 112 from engagement with the fast idle cam face 100, thereby permitting the fast idle cam to be moved to the position shown aligning the high step 102 with screw 112. No vacuum exists in tube 150 so that servo 126 is in the position shown eccentrically rotating the fast idle cam axis 108 clockwise about the axis 122 of lever 124. This locates the fast idle cam leftwardly its maximum amount so that the throttle lever screw 112 causes the throttle valves 36 to be opened the maximum amount desired for a cold engine start.

Assume now that the engine has fired. The firing vacuum is still insufficient to move servo 126 so that the throttle valves remain in the positions indicated in FIG. 3. As soon as the engine reaches sustained operation, however, the manifold vacuum present in tube 150 moves diaphragm 130 leftwardly to pivot lever 124 about its axis 122. This simultaneously moves the eccentrically mounted fast idle cam 86 counterclockwise about the axis 122 as seen in FIG. 3. In effect, the fast idle cam moves rightwardly, with the throttle lever screw 112 remaining in contact with the high step face 102 to slightly close down the throttle valves by an increment that decreases the air flow through the carburetor and thus reduces the fast idle speed of the engine. From this point forward, so long as the engine remains running, all fast idle action will occur as a result of pivotal movement of the fast idle cam 86 about its axis 108 rather than a lateral movement of the cam.

As the engine warms, the end 66 of thermostatic spring 68 will move arcuately or circumferentially clockwise so as together with the force of modulating spring 76 rotate levers 58 and 46 clockwise to progressively open the choke valve wider. At the same time, as seen in FIG. 3, the clockwise rotation of lever 46 permits the fast idle cam linkage to follow and accordingly rotate the fast idle cam clockwise. This will progressively present the lesser radial extent steps 104, 106 and finally opening 110 for engagement with throttle lever screw 112. This will progressively decrease the throttle valve openings until the screw finally engages in recess 110 of the fast idle cam, at which point the throttle valves will have closed to their engine normal operating temperature idle speed positions essentially closing the induction passage. Similarly, if the temperature should decrease, the force of the thermostatic spring 68, as modulated by spring 76, exerts a closing force on the choke valve 28 and fast idle cam 86 by urging the levers 46 and 58 in a counterclockwise direction to gradually close the choke valve and also reposition the fast idle cam towards its high cam step 102 setting upon disengaging of the screw 112 from the cam face engaged and reengagement with step 102.

It should be understood that during all engine operations, the air load on the choke valve will normally cause the link 48 and pin 52 to be located at the upper edge of the slot 54 in lever 46. Therefore, regardless of whether the lever is moving clockwise or counterclockwise, the air load on the choke valve will maintain the end 52 in the position indicated.

An additional feature provided by the construction is to provide a maintained fast idle speed position of the throttle valve for a period of time even though the choke valve is rotated to its wide open position. This permits larger volume air flow at temperature levels which in a conventional carburetor would close down the throttle valves to their normal idle speed position. When thermostatic spring 68 has rotated levers 46 and 58 to a position where choke valve 28 is positioned in the vertical or wide open position, fast idle throttle lever screw 112 will still be in a position engaging the lower cam step 106, thus providing additional fast idle air flow. Further rotation of lever 46 by the thermostatic spring 68 is permitted by the end 52 of the choke lever link 48 moving the length of the slot 54 from top to bottom. This small movement, which amounts to approximately 14°, is sufficient to permit the fast idle cam to rotate to a position wherein the screw 112 will then align with the opening 110 and finally permit the throttle valves to close to their engine normal idle close positions.

Upon engine shutdown, the parts will take the positions determined by the thermostatic spring 68 and modulating spring 76. The fast idle cam 86 will be repositioned according to the position of the springs, and will be eccentrically rotated clockwise about the axis of rotation 122 by the servo spring 152, to reposition the throttle valve screw 112 for an opening of the throttle valves in proportion to that called for by the position of the thermostatic spring 68 and modulating spring 76.

It will be understood that the starting of the engine under conditions that are warmer than the coldest conditions described will locate the choke valve 28 and fast idle cam 86 for greater choke openings and less engine speeds, respectively, in proportion to the richness of the air/fuel ratio and engine speed called for by that particular temperature level. That is, as the engine warms, the air/fuel ratio will become progressively leaner for starting purposes, and the engine speed need be less since the friction and viscosity of the lubricant, etc., is correspondingly less.

From the foregoing, it will be seen that a carburetor has been described that provides a choke plate pull-close solenoid for starting purposes, improved pull-down modulation, an eccentrically mounted fast idle cam for automatic gradual speed reduction after engine startup, and continued fast idle cam operation subsequent to choke valve inoperativeness.

While the invention has been shown and described in its preferred embodiment, it will be clear to those skilled in the arts to which it pertains, that many changes and modifications may be made thereto without departing from the scope of the invention.

We claim:

1. A carburetor having an air/fuel induction passage open at one end to air at essentially atmospheric pressure and connected at its opposite engine end to an engine intake manifold to be subject to the changing vacuum levels therein, the one end having a choke valve unbalance mounted for a rotatable movement by gravity and airflow thereagainst across the one end between a closed position and a wide open inoperative position wherein the choke valve is inoperative to restrict the flow of air into the passage, and a throttle valve secured on a shaft rotatably mounted posterior of the choke valve for movement of the throttle valve across the passage between an engine normal operating temperature level essentially closed engine idle speed position and beyond towards a wide open throttle position to control the volume of flow of an air/fuel mixture through the passage as a function of the position of the throttle valve, the control comprising means operable during engine operations between the normal operating temperature to provide a controlled positioning of the throttle valve relative to the position of the choke valve, to improve emissions while minimizing engine stalling, the last mentioned means including throttle valve abutment means secured to the throttle valve shaft, a second shaft, a fast idle cam rotatably mounted on the second shaft and having an edge formed with a number of steps progressively decreasing circumferentially in radial extent than one which when aligned with the abutment means permits closure of the throttle valve to the normal engine idle speed position, whereby the throttle valve will be progressively opened beyond the latter position as a function of the particular step engaged by the abutment means, spring means biasing the abutment means and throttle valve towards a closed position and into individual engagement with one of the steps, a thermostatically responsive coiled spring operatively effecting the rotation of the fast idle cam to positions operatively moving the throttle valve to positions progressively more open than the normal idle speed position as a function of decreases in temperature from a predetermined level, a first lever fixed to the choke valve for rotation therewith, a second lever fixed for rotation with the thermostatic spring, a link pivotally interconnecting the first and second levers, the means interconnecting the levers and link including a lost motion pin and slot connection permitting relative rotational movement between the link and one of the levers, a third lever rotatably mounted with respect to the thermostatic spring and having a one-way engagement with the second lever permitting independent movement of the second lever in a choke valve opening direction while forcing concurrent movement of the second lever with the third lever upon movement of the third lever in the other direction, and linkage means pivotally connecting the third lever and fast idle cam permitting the fast idle cam to be rotated from a first position engaged with a step on the cam while the choke valve is in wide open position to a second position out of engagement with the abutment means while the choke valve is still maintained in a wide open position.

* * * * *